US008522770B2

(12) United States Patent
Colburn et al.

(10) Patent No.: US 8,522,770 B2
(45) Date of Patent: Sep. 3, 2013

(54) RECIRCULATING, SELF-CONTAINED VENTILATION SYSTEM

(75) Inventors: Michael G. Colburn, Burlington, VT (US); Sarah Doyle Andrews, Winooski, VT (US); Iver I. Bjerke, Charlotte, VT (US); Lisa Carol Bombardier, Eden, VT (US); Stephen John Bogner, Colchester, VT (US)

(73) Assignee: SA Vent, LLC, Providence, RI (US)

( * ) Notice: Subject to any disclaimer, the term of this patent is extended or adjusted under 35 U.S.C. 154(b) by 1148 days.

(21) Appl. No.: 12/198,599

(22) Filed: Aug. 26, 2008

(65) Prior Publication Data

US 2010/0051010 A1 Mar. 4, 2010

(51) Int. Cl.
*F24C 15/20* (2006.01)

(52) U.S. Cl.
USPC ..... 126/299 D; 126/299 R

(58) Field of Classification Search
USPC ..... 237/47; 99/474; 454/234, 235, 454/56–58, 60–62, 65, 67, 188–193, 49; 126/300–303, 299 C–299 F, 80, 312, 550
See application file for complete search history.

(56) References Cited

U.S. PATENT DOCUMENTS

| | | | | | |
|---|---|---|---|---|---|
| 2,608,190 | A | * | 8/1952 | Winning et al. | 126/25 A |
| 3,260,189 | A | * | 7/1966 | Jensen | 126/299 D |
| 3,292,525 | A | * | 12/1966 | Jensen | 126/299 D |
| 3,303,839 | A | * | 2/1967 | Tavan | 126/299 D |
| 3,381,679 | A | | 5/1968 | Gonzalez | |
| 3,386,365 | A | * | 6/1968 | Jensen | 454/191 |
| 3,391,689 | A | | 7/1968 | Raul | |
| 3,486,307 | A | | 12/1969 | Mcdermott | |
| 3,785,124 | A | | 1/1974 | Gaylord | |
| 3,807,148 | A | * | 4/1974 | Fike et al. | 96/121 |
| 3,954,427 | A | | 5/1976 | Jenn | |
| 4,011,802 | A | | 3/1977 | Molitor | |
| 4,038,056 | A | | 7/1977 | Diachuk | |
| 4,050,446 | A | | 9/1977 | Giuffre | |
| 4,105,422 | A | | 8/1978 | Kiguchi | |
| 4,122,834 | A | | 10/1978 | Jacobs | |
| 4,124,021 | A | | 11/1978 | Molitor | |
| 4,284,421 | A | | 8/1981 | Howard | |
| 4,285,390 | A | | 8/1981 | Fortune | |
| 4,350,504 | A | | 9/1982 | Diachuk | |
| 4,407,266 | A | | 10/1983 | Moliter | |

(Continued)

OTHER PUBLICATIONS

Sherer, Mike, "A Case of De-Duct-ion," Foodservice Equipment Reports, Apr. 2004, Gill Ashton Publishing, Evanston, IL United States.

(Continued)

*Primary Examiner* — Michael Peffley
*Assistant Examiner* — Thomas Giuliani
(74) *Attorney, Agent, or Firm* — James Marc Leas

(57) ABSTRACT

A system includes an intake, an exhaust, and an adjustable directing member. The intake is for taking in air, the exhaust is for exhausting air, and the adjustable directing member is positioned for directing exhaust air toward the intake. Another aspect is a system that includes a source of polluted air and an air cleaning system. The air cleaning system includes an intake, an exhaust, and a directing member. The intake is for taking in polluted air and the exhaust is for exhausting air. The directing member is for directing air from the exhaust toward the intake to provide an air screen for keeping the polluted air in the vicinity of the intake.

40 Claims, 21 Drawing Sheets

(56) References Cited

U.S. PATENT DOCUMENTS

| | | | | | |
|---|---|---|---|---|---|
| 4,423,669 | A | * | 1/1984 | Bullock et al. | 454/191 |
| 4,484,563 | A | | 11/1984 | Fritz | |
| 4,489,647 | A | | 12/1984 | Stamps | |
| 4,721,094 | A | | 1/1988 | Nett | |
| 4,854,949 | A | | 8/1989 | Giles | |
| 4,941,400 | A | | 7/1990 | Moore | |
| 5,002,040 | A | | 3/1991 | Macfarlane | |
| 5,042,456 | A | * | 8/1991 | Cote | 126/299 D |
| 5,133,786 | A | | 7/1992 | Anderson | |
| 5,154,161 | A | * | 10/1992 | Rogers et al. | 126/299 D |
| 5,251,608 | A | * | 10/1993 | Cote | 126/299 D |
| 5,285,771 | A | | 2/1994 | Griffes | |
| 5,906,195 | A | | 5/1999 | Georgaras | |
| 5,941,235 | A | | 8/1999 | Carter | |
| 6,142,142 | A | | 11/2000 | Woodall, III | |
| 6,170,480 | B1 | * | 1/2001 | Melink et al. | 126/299 R |
| 6,334,074 | B1 | | 12/2001 | Spertell | |
| 6,752,144 | B1 | * | 6/2004 | Lee | 126/299 D |
| 6,817,356 | B2 | | 11/2004 | Gallagher | |
| 7,000,640 | B2 | | 2/2006 | Butera | |
| 7,503,842 | B2 | * | 3/2009 | Lee et al. | 454/66 |
| 2004/0194777 | A1 | * | 10/2004 | Antoniello | 126/299 R |
| 2008/0029081 | A1 | * | 2/2008 | Gagas et al. | 126/299 D |
| 2008/0135041 | A1 | * | 6/2008 | Robison | 126/299 D |

OTHER PUBLICATIONS

Report: "Stainless Report: NFPA 96 Interpretation of 1994 Edition Recirculating Systems," Vent Master Corporation, Mississauga, Ontario, Canada.

Taecker, John, "Understanding Recirculating Hood Systems—A Practical Alternative to Conventional Ducted Hoods," The Code Authority Publication, A newsletter for the Code Community, Fall 2005, pp. 1 & 5 Underwriters Laboratories Inc, Camas, WA United States.

* cited by examiner

RECIRCULATING, SELF-CONTAINED VENTILATION SYSTEM

FIELD

This patent application generally relates to a recirculating, self-contained ventilation system. More particularly it relates to recirculating ventilation system for commercial electric counter-top cooking and heating appliances.

BACKGROUND

Fixed building ventilation systems for installation over groupings of cooking equipment pieces have required ventilation ductwork extending to the exterior of the building, often with the ductwork extending through multiple floors. In addition these systems have required make up or return air ducted back to the vented areas. Such systems required considerable expense and have been complex to install and maintain in buildings.

In some cases small electric cooking equipment has been positioned away from the kitchen spaces and has not been vented. In these cases additional risk of fire is created or that moisture, heat, smoke, odor or grease laden air will pollute the air and create an unhealthy or uncomfortable condition for workers or patrons. A complicating condition when localized venting equipment has been used in such situations has been that breezes or air conditioning causes air movements that can interfere with capture of polluted air generated by the cooking appliance, and allow the smoke, particulates, heat, and grease laden polluted air to be released into the room.

A better way to vent an individual piece of cooking equipment has become desirable, and this solution is provided by the following description.

SUMMARY

One aspect of the present patent application is a system that includes an intake, an exhaust, and an adjustable directing member. The intake is for taking in air, the exhaust is for exhausting air, and the adjustable directing member is positioned for directing exhaust air toward the intake.

Another aspect is a system that includes a source of polluted air and an air cleaning system. The air cleaning system includes an intake, an exhaust, and a directing member. The intake is for taking in polluted air and the exhaust is for exhausting air. The directing member is for directing air from the exhaust toward the intake to provide an air screen for keeping the polluted air in the vicinity of the intake.

Another aspect is a system that includes an appliance and a free standing recirculating ventilation system. The appliance produces polluted air. The free standing recirculating ventilation system takes in the polluted air, filters the polluted air, and exhausts air that has pollution removed.

Another aspect is a system that includes a plurality of capture hoods and a hood supporting unit. Each of the plurality of capture hoods has a hood portion and a connection portion. The connection portion is for connection to the hood supporting unit. The hood supporting unit is capable of connecting to just one of the plurality of capture hoods at a time. The hood portions of the plurality of capture hoods have different shapes. The connection portions of the plurality of capture hoods are identical so any one of the plurality of capture hoods can connect to the hood supporting unit.

Another aspect is a system that includes a recirculating ventilation system having an air curtain.

BRIEF DESCRIPTION OF THE DRAWINGS

The foregoing will be apparent from the following detailed description, as illustrated in the accompanying drawings, in which.

DETAILED DESCRIPTION

A recirculating, self-contained ventilation system for commercial electric counter-top cooking and heating appliances is disclosed. The system provides what is known as a "ductless hood" because no duct extends for venting to the exterior of the building housing the equipment. The system includes internal air ducts and an air handling system suitable for installation in remote areas away from locations with external venting. The air handling system provides for filtering or treatment of grease laden air, smoke, heat, moisture and odor that may be released by an appliance, such as a panini grill. The system includes an air screen that keeps polluted air in the recirculating ventilation system, or any other equpment that produces polluted air.

As used in this application, a recirculating ventilation system is one that has an intake and an exhaust, and air from the exhaust is directed toward the intake.

Figure 1:
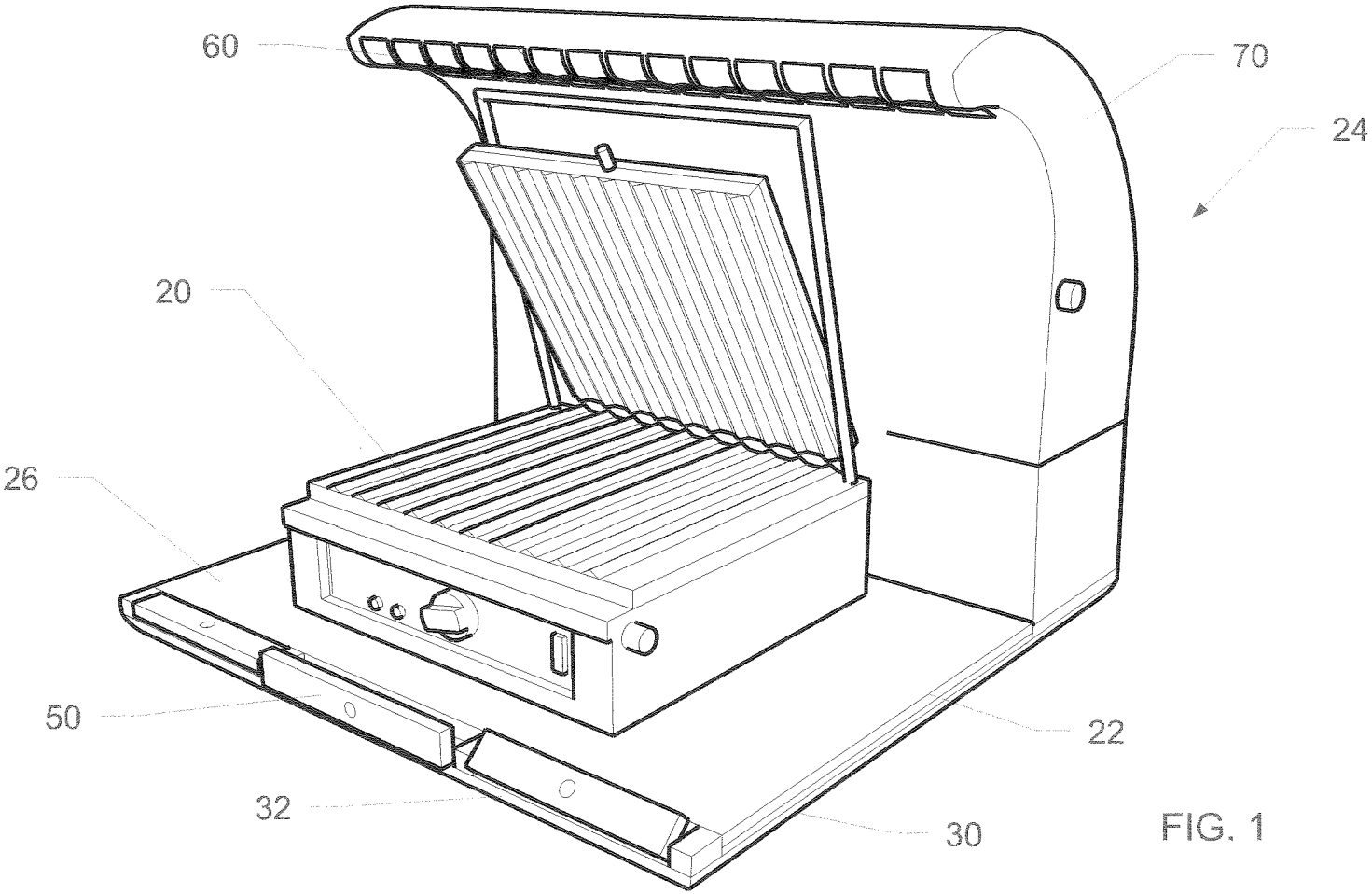
FIG. 1 is a perspective view showing a recirculating ventilation system for venting an appliance located on a base and under a hood in which the base has exhaust air louvers and the hood has an air intake, and in which the exhaust air louvers are positioned to direct exhaust air towards the air intake of the hood.
Figure 2:
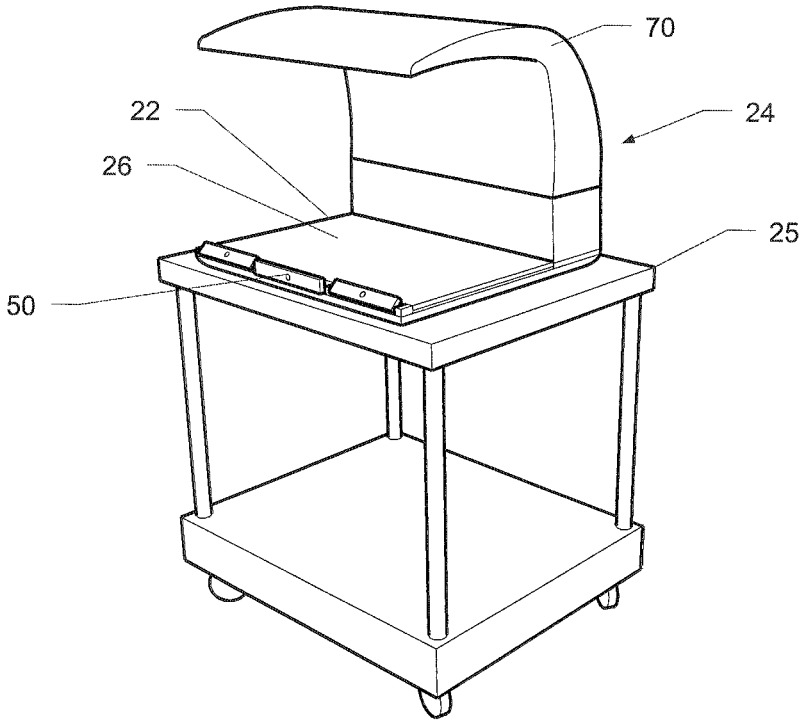
FIG. 2 is a perspective view of a recirculating ventilation system mounted on a cart.

Appliance 20 sits on base 22 of structure 24, as shown in FIG. 1. Base 22 rests on a counter top (not shown) or on cart 25 so it can be moved from place to place, as shown in FIG. 2. Base 22 includes as its top surface platform pan 26, which is formed of easily cleanable and non-combustible metal, such as stainless steel, aluminum, or powder coated steel. Platform pan 26 is positioned to directly contact appliance 20 when appliance 20 sits on base 22, as shown in FIG. 1. Platform pan 26 has a larger area than the footprint of cooking appliance 20 and provides a fire resistant surface for any hot items that may contact its surface. Appliance 20 can be a cooking appliance, such as a grill, a panini grill, an oven, a fryer, a warmer, a toaster, a crepe maker, a broiler, or a steamer. Appliance 20 can also be a food warming or hot food holding appliance. Appliance 20 can also be lab equipment, repair shop equipment, industrial process equipment, or an industrial process station.

Figure 3:
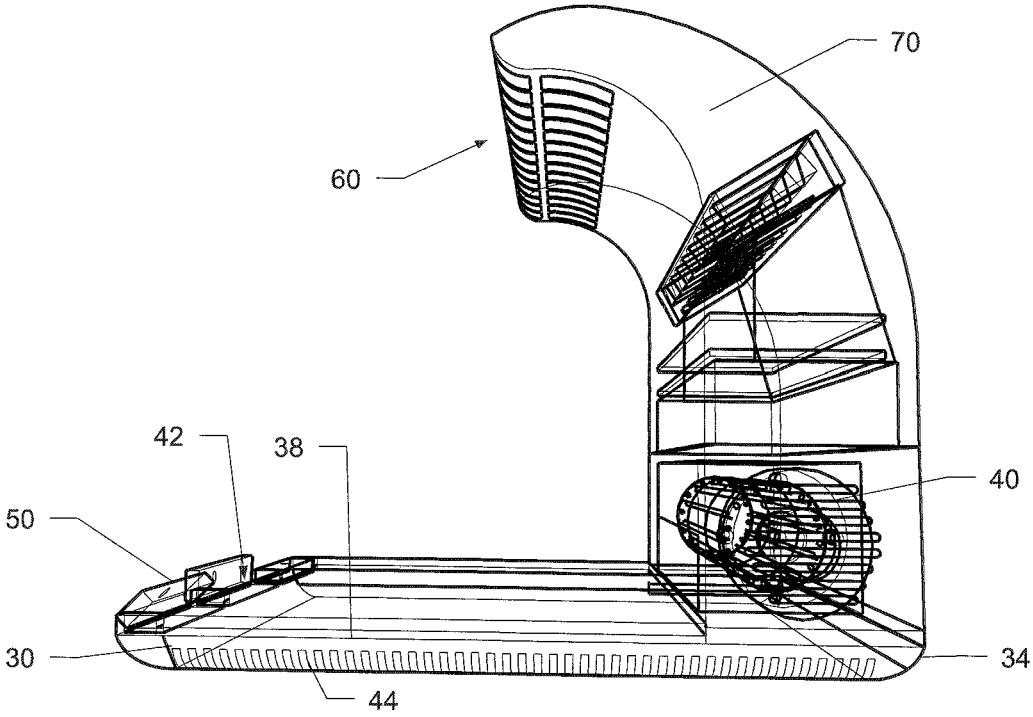
FIG. 3 is a side x-ray view of the recirculating ventilation system of FIG. 1.

In addition to platform pan 26, base 22 also has side walls 30, front wall 32, rear wall, 34, and sub-floor surface 36 that together provide duct 38, as shown in FIG. 3 and FIGS. 4*a*-4*c*. Duct 38 extends to provide air flow across base 22 from fan 40 toward exhaust 42 adjacent front wall 32 through which a portion of air from fan 40 exhausts. Sub-floor surface 36 may have access panel 38 which may have a perforated portion and side walls 30 can include venting slots 44 to exhaust another portion of this air, as shown in FIGS. 1 and 3.

Figure 5:
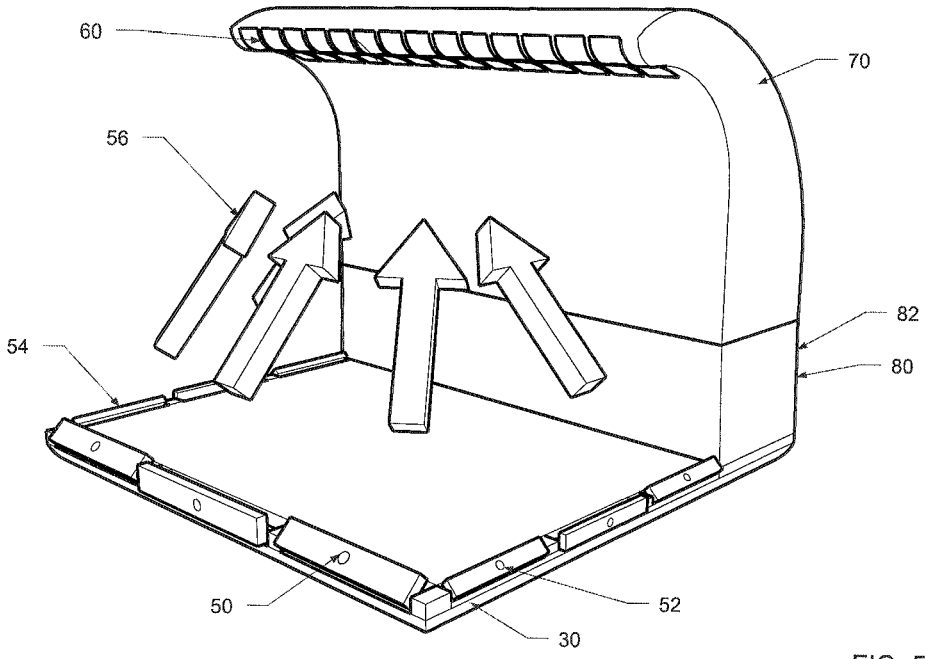
FIG. 5 is a perspective view showing air flow directed from air louvers on three sides towards the air intake of the hood.

Exhaust 42 of platform pan 26 is fitted with multi-directional adjustable exhaust louvers 50 from which cleansed air is released. Additional exhaust louvers 52, 54 may also be installed on side walls 30 of base structure 22, as shown in FIG. 5. Exhaust louvers 50, 52, 54 are adjustable to directionally project air curtain 56 in front of and around cooking appliance 20 toward intake 60 of hood 70. The directional flow of air curtain 56 in front of and around cooking appliance 20 toward intake 60 traps emissions from and polluted air around cooking appliance 20 and helps direct that polluted air toward intake 60 and within the recirculating ventilation system. Air curtain 56 enhances air and particulate capture by hood intake 60 and restricts loss of polluted air into the room as a result of breezes or air conditioning that might otherwise affect the recirculating and treatment operation.

Figure 4A:
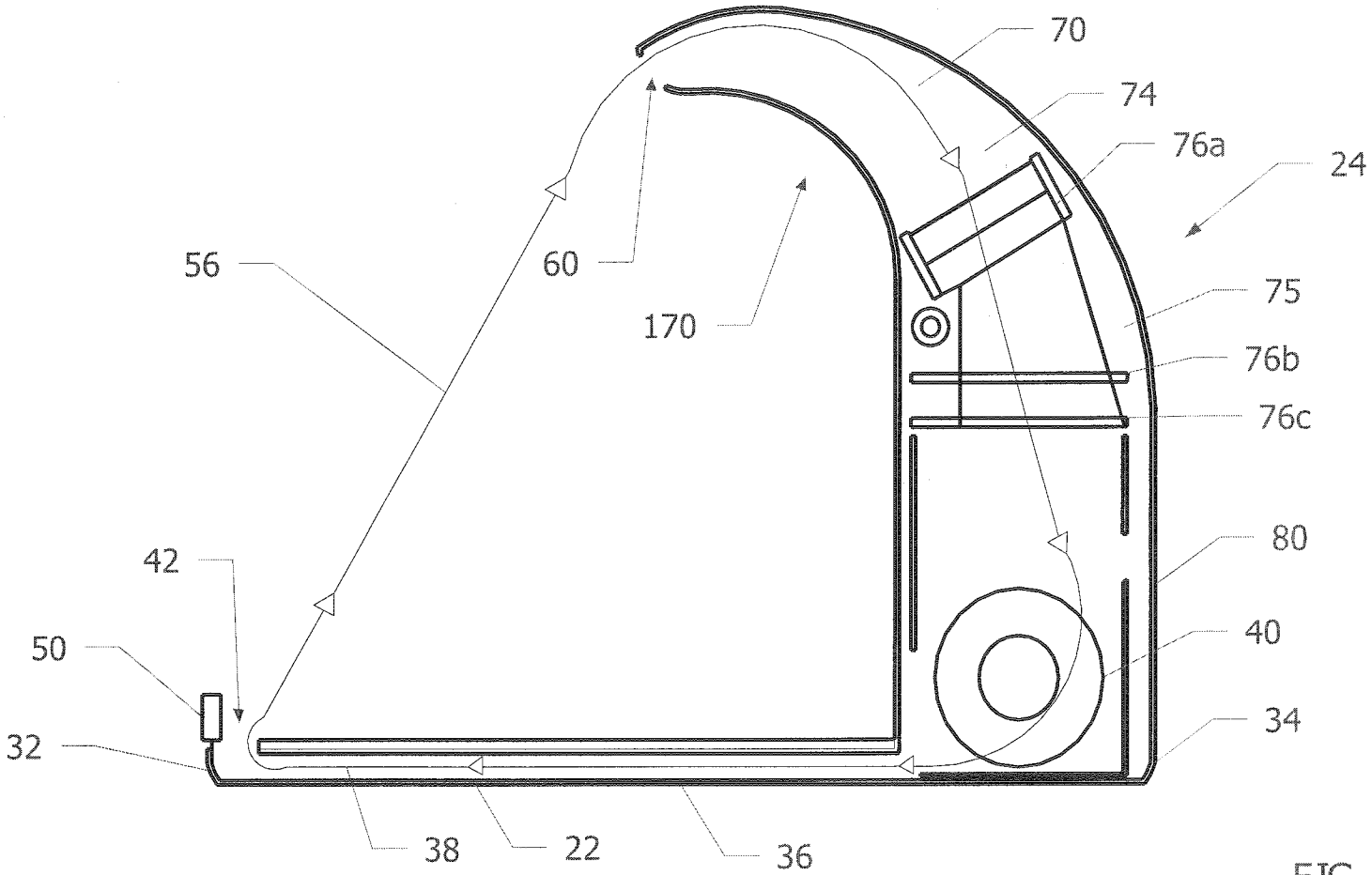
FIG. 4*a* is a side cross sectional view of the recirculating ventilation system of FIG. 1 showing air louvers directing exhaust air towards the air intake of the hood and showing the fan and filters for cleaning the air.
Figure 4B:
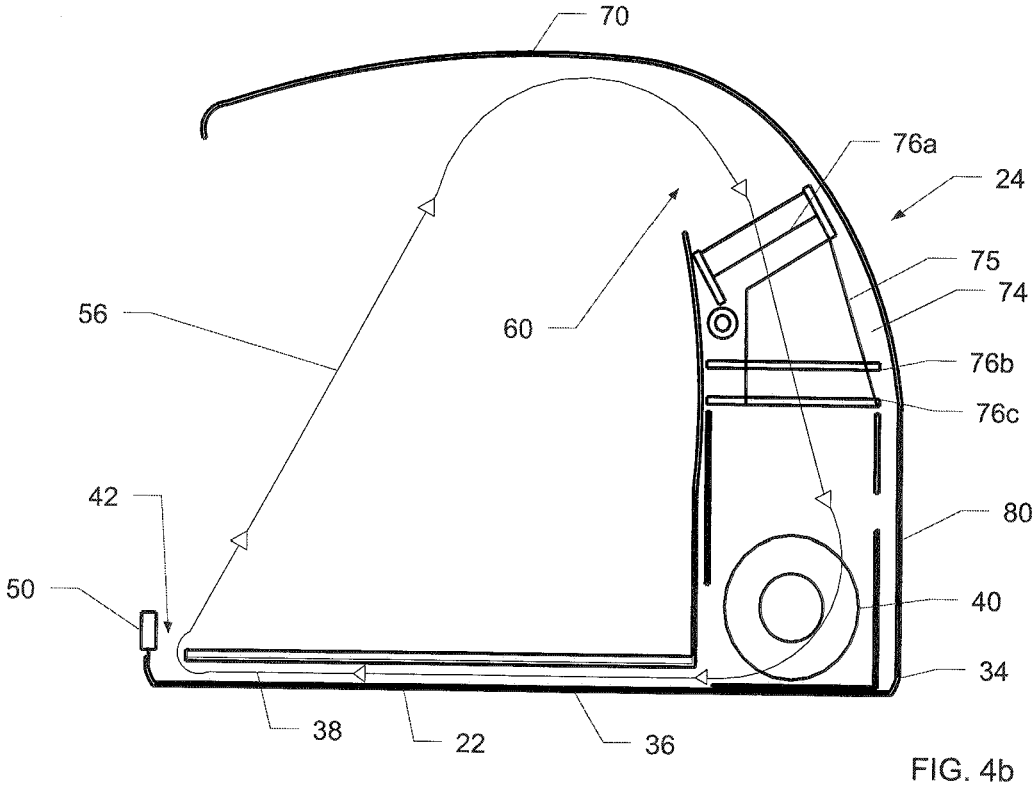
FIG. 4*b* is a side cross sectional view of a recirculating ventilation system with a different hood showing air louvers directing exhaust air towards the air intake of the hood and showing the fan and filters for cleaning the air.

Adjacent rear wall 34 of base 22 motor 72 is connected to tangential fan 40 to provide for flow of air into intake 60 and out of exhaust 42, as shown in FIGS. 4*a*, 4*b*. Air is supplied from intake 60 through duct 74 in hood 70 that directs air through air treatment modules 75 that clean the air and provide cleaned air at tangential fan 40 for redirection into duct 38 in base 22 and to exhaust 42.

Air treatment modules 75 include grease filter 76*a*, particulate filter 76*b*, and a deoderizing charcoal filter 76*c* for cleaning the polluted air and capturing contaminants. Grease filter 76*a* is an aluminum filter with change of direction flow to absorb heat and cool the air and to remove grease particulates. Removable grease collector 78 allows for collection and removal of accumulated grease. Other kinds of air treatment modules can also be included for the extraction or treatment of grease, particulates, steam, and for treatment of odor and heat in the air passing down through riser duct 82 towards fan 40. For example, an electrostatic precipitator and a catalytic converter can be included. They can be installed as a part of grease filter 76*a*, in addition to grease filter 76*a*, or in the place of grease filter 76*a*.

Grease filter 76*a* is available from Component Hardware Group, Lakewood, N.J. Particulate filter 76*b* and deoderizing charcoal filter 76*c* are available from Air Filters, Inc., Houston Tex. Combination filters that includes a grease filter and a catalytic converter are available from Applied Catalysts, Doraville, Ga.

Filter frame 90 houses each of the individual removable air treatment modules 75, such as filters 76*a*-76*c*, as shown in FIGS. 4*a*-4*b* and 6*a*-6*c*. Filter frame 90 includes directional ducting 74' for providing air flow through each filer 76*a*-76*c*.

Fan housing 80 encloses tangential fan 40 and effects the approximated 90 degree direction change in air flow at tangential fan 40, as shown in FIGS. 3, 4*a*-4*c* and 6. Within fan housing 80 tangential fan 40 is wide enough to supply air across a majority of the width of base structure 22, as shown in FIG. 6*a*, 6*b*.

Figure 6A:
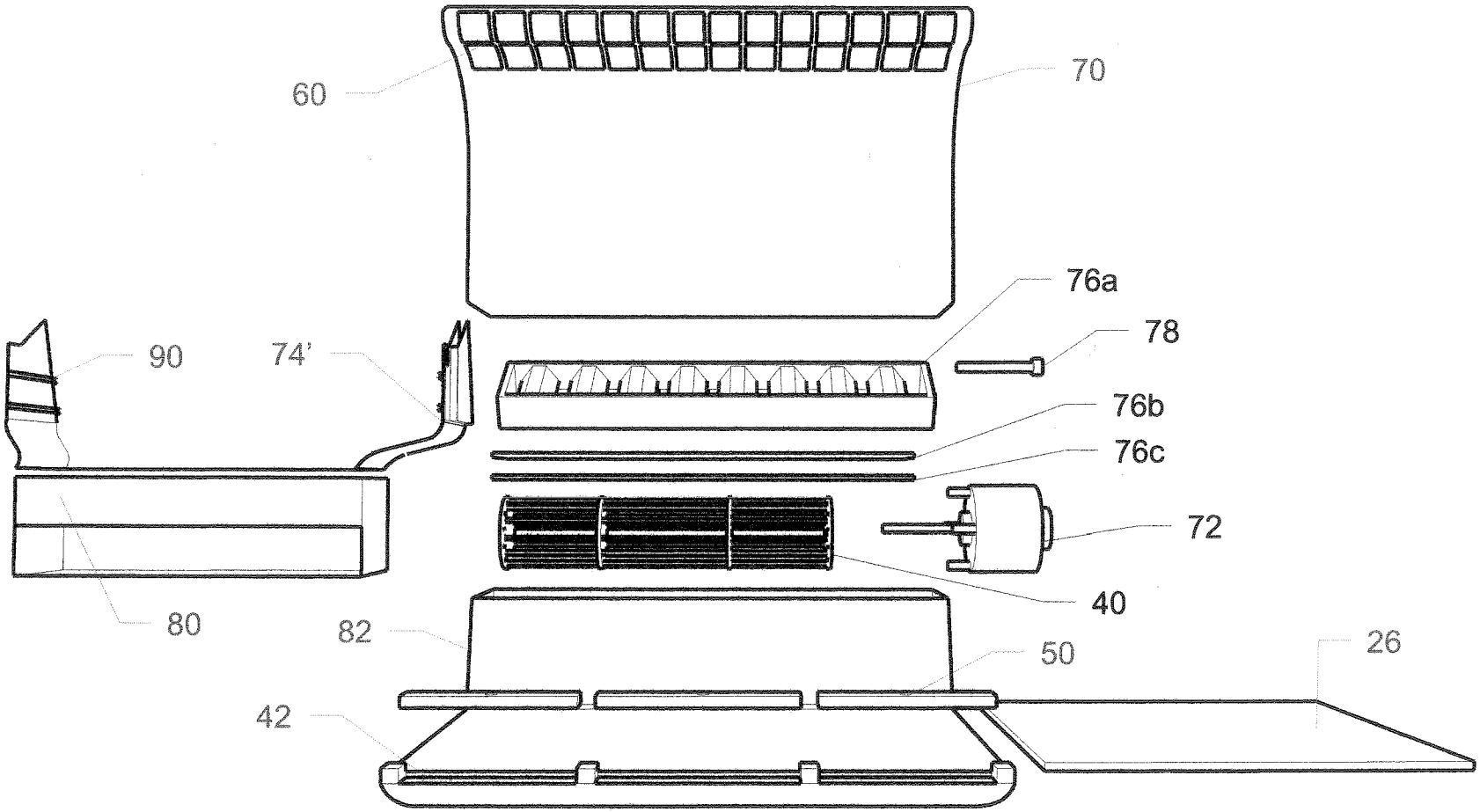
FIG. 6*a* is an exploded front view of the recirculating ventilation system of FIG. 1 showing the base, the platform pan, the air louvers, the riser, the filter frame and filters, the motor, the fan, and the hood.
Figure 6B:
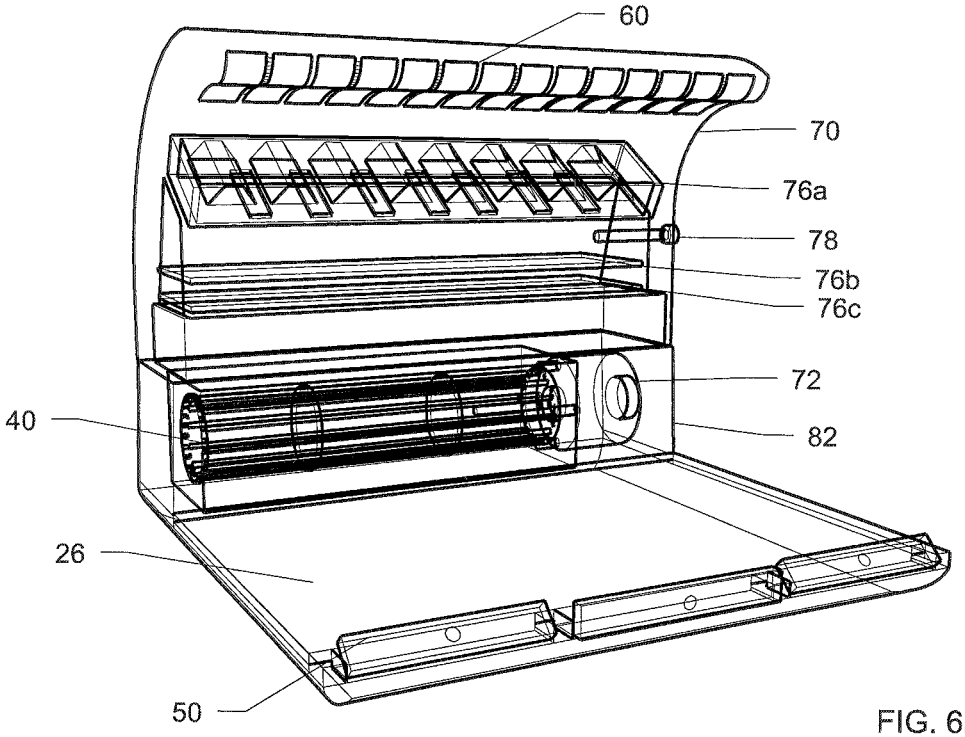
FIG. 6*b* is an assembled perspective x-ray view of the recirculating ventilation system of FIG. 6*a;*

Duct 38 has a first configuration and a second configuration, as shown in FIGS. 6*a*-6*b*. When duct 38 is in the first configuration it includes platform pan 26 and has its top enclosed by said platform pan 26, as shown in FIG. 6*b*. When duct 38 is in the second configuration duct 38 has its top open. In one embodiment, platform pan 26 is removed from duct 38, as shown in FIG. 6*a*. Enclosing and opening duct 38 with platform pan 26 allows duct 38 to go back and forth between the first configuration and the second configuration. When platform pan 26 encloses duct 38 platform pan 26 is positioned for supporting appliance 20 in structure 24, as shown in FIG. 1.

Figure 6C:
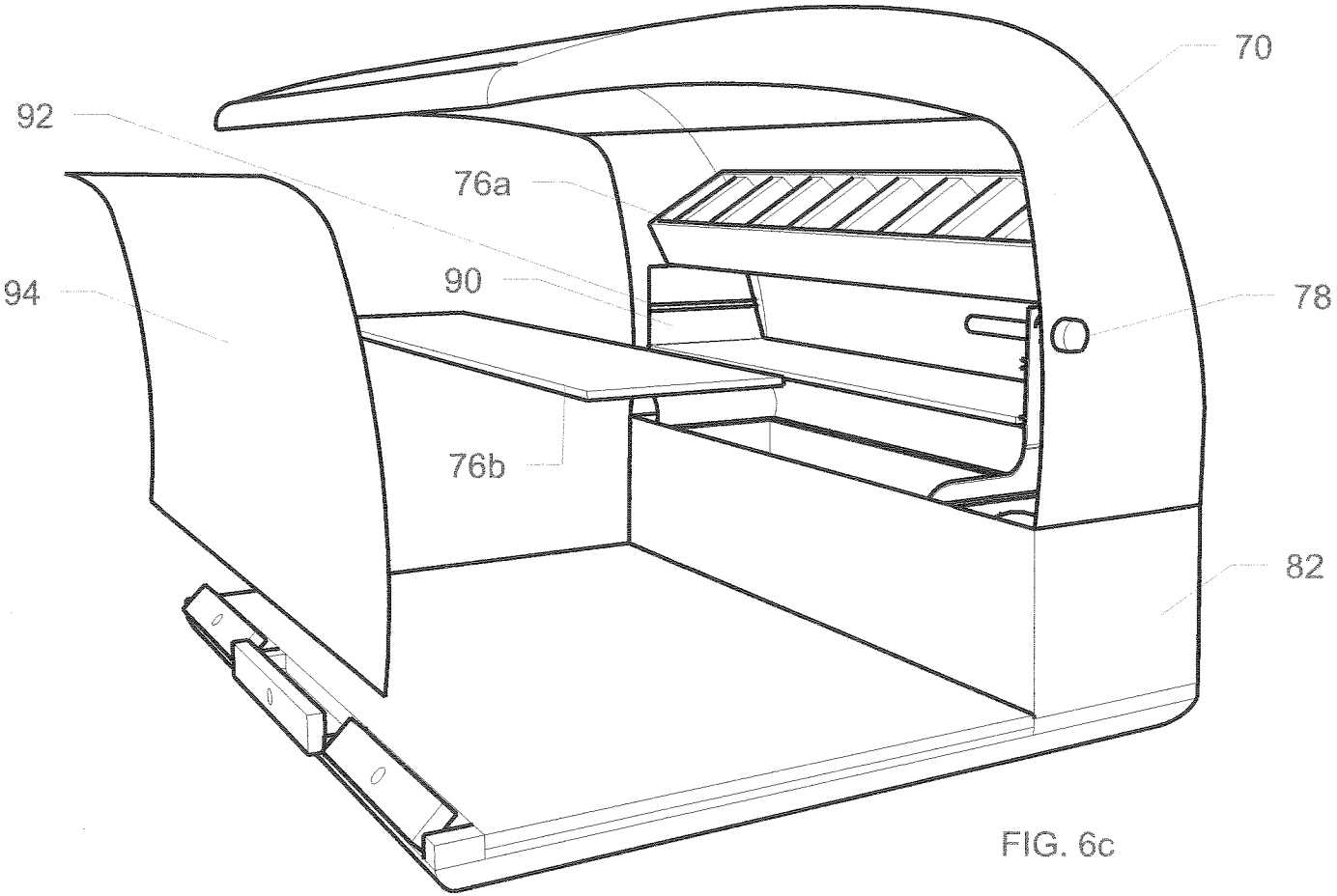
FIG. 6*c* is an assembled perspective view of the recirculating ventilation system of FIG. 6*a* with the removable access panel open and one filter removed.

Riser duct 82 extending from platform pan 26 toward air capture hood 70 houses motor 72, fan 40, fan housing 80, and air treatment modules 75. Riser duct 82 also includes filter frame 90, which has filter slots 92, as shown in FIGS. 6*a*-6*c*. Filter slots 92 support individual removable air treatment modules 75, such as filters 76*a*-76*c*. Removable access panel 94 allows access to removable air treatment modules 75 for servicing or replacement.

Figure 7:
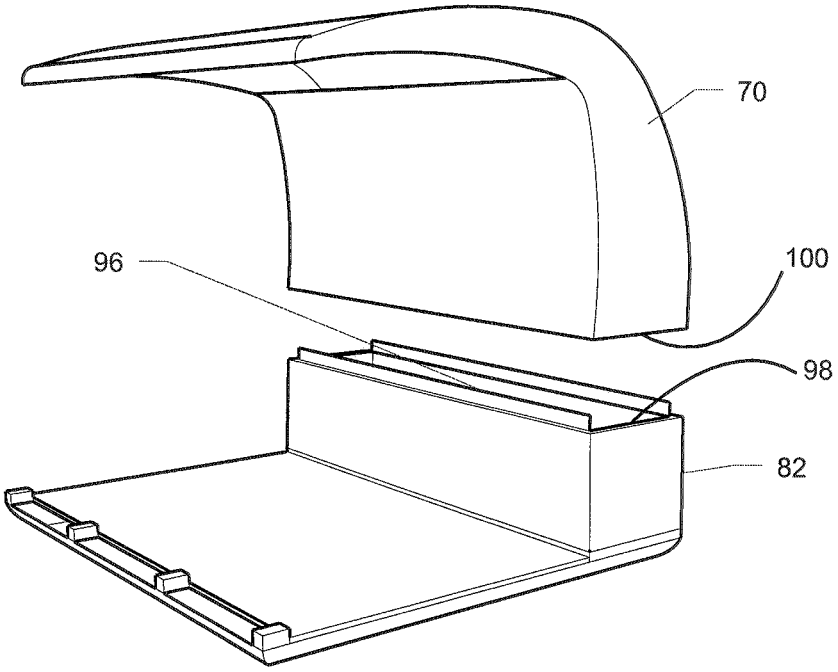
FIG. 7 is a perspective view showing the recirculating ventilation system of FIG. 2 with the vent capture hood removed from the connection collar.

Connection collar 96 is connected between top end 98 of riser duct 82 and bottom end 100 of capture hood 70, as shown in FIG. 7. Connection collar 96 may be connected to capture hood 70 and to riser duct 80 using a tool-less connector system, such as available from Tinnerman Fasteners, Brunswick, Ohio.

Figure 8A:
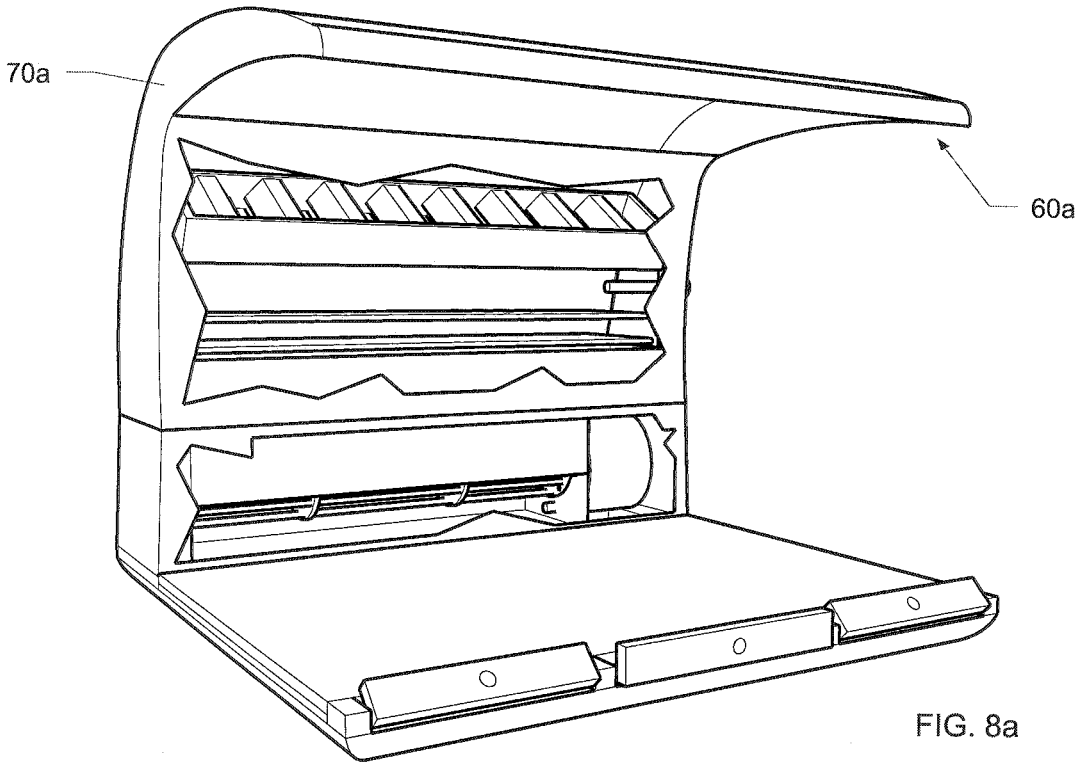
FIGS. 8*a*-8*c* are perspective view showing a recirculating ventilation system with different vent capture hoods mounted to the same hood supporting unit that includes a connection collar, a riser and a base.
Figure 8B:
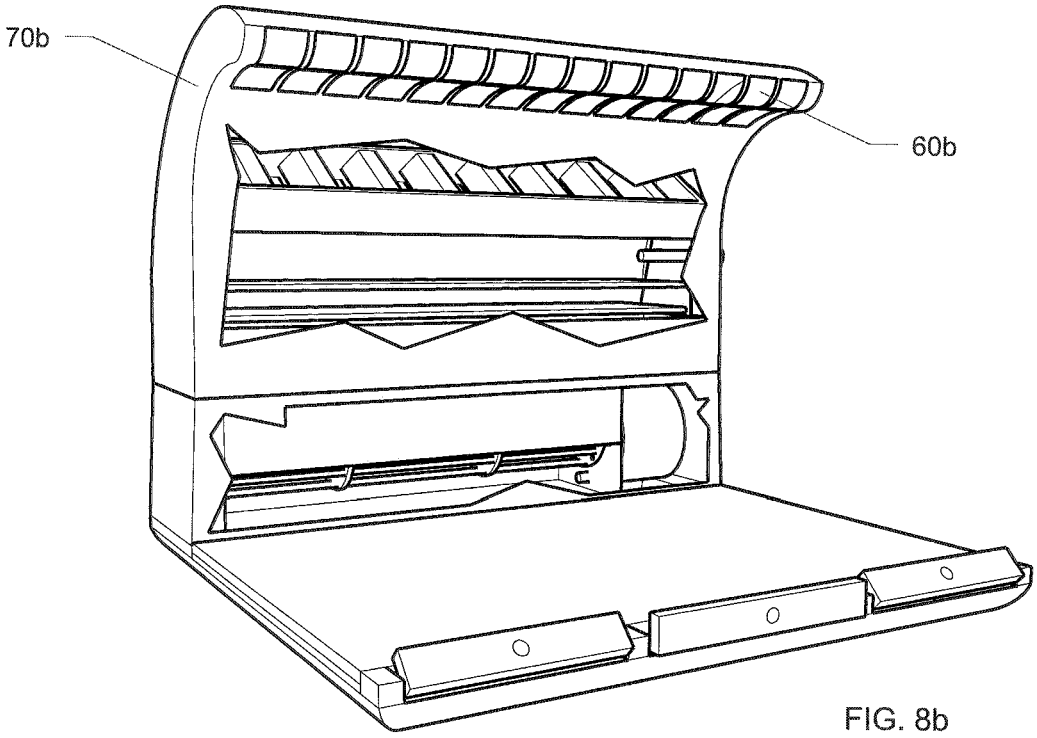
Figure 8C:
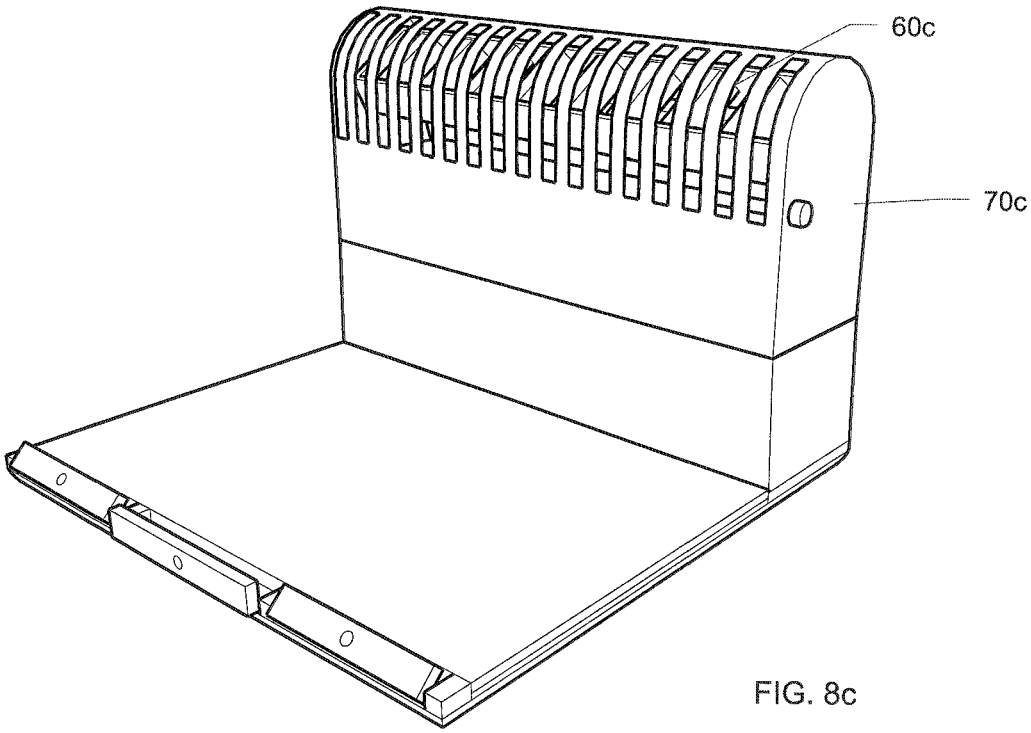

Capture hood 70 is modular and replaceable, and another one with a different size can be installed when a particular cooking appliance is replaced with one that has different characteristics, as shown in FIGS. 8*a*-8*d*. For example, intake 60*a* is located in a portion of hood 70*a* corresponding to the flow of polluted air from the front of a cooking appliance with a front opening door, such as a convection oven, as shown in FIG. 8*a*. Intake 60*b* is located in a portion of hood 70*b* corresponding to the flow of polluted air from an open topped cooking appliance, such as a flat grill or a panini grill, as shown in FIG. 8*b*. This leaves room for the operator to add or remove food items from the open topped cooking appliance. In yet another example, capture hood 70*c* is positioned lower with vertical intake slots 104 located to receive air from a cooking appliance that emits cooking air from a back wall of the appliance, such as a portion steamer, as shown in FIG. 8*c*. Connection collar 96 is positioned to receive any of capture hoods 70*a*, 70*b*, 70*c*. The shape and size of capture hood 70 chosen is determined by the cooking appliance to be vented but all of them fit equally well on connection collar 96 and on riser duct 82.

Figure 9:
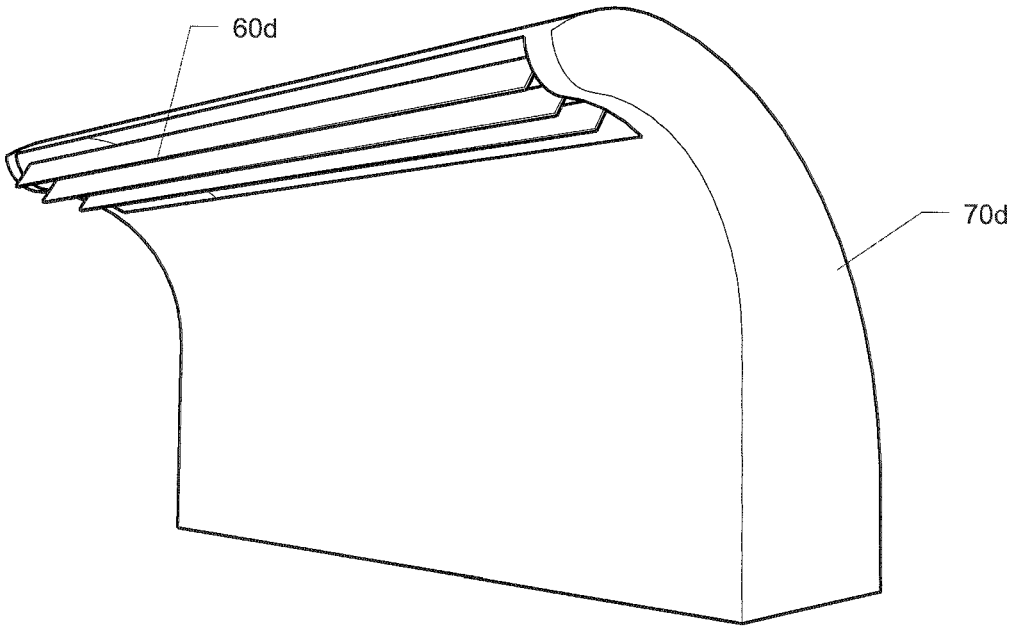
FIG. 9 is a perspective view showing a recirculating ventilation system with a vent capture hood that has adjustable louvers over the air intake.

In one embodiment, adjustable air intake 60*d* on capture hood 70*d* permits adjusting the surface area of the air intake, as shown in FIG. 9. Adjustable air intake 60*d* can be used to control the velocity of air entering and provides additional control for balancing air flow.

Figure 10:
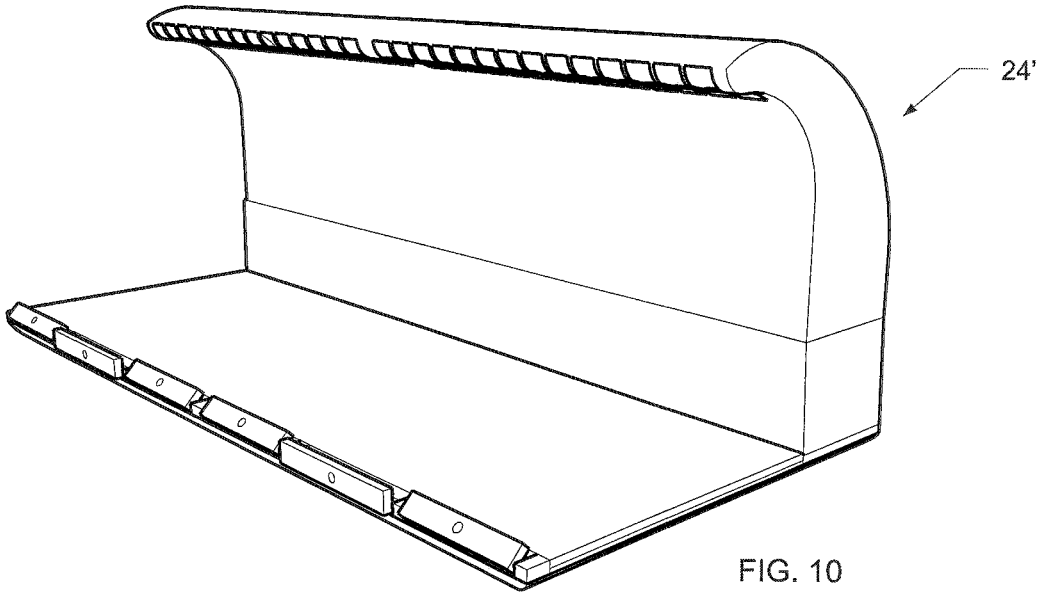
FIG. 10 is a perspective view showing an elongated recirculating ventilation system.

Single, elongated structure 24' is used for supporting and venting several cooking appliances, as shown in FIG. 10, and can include several tangential fans 40.

Figure 11:
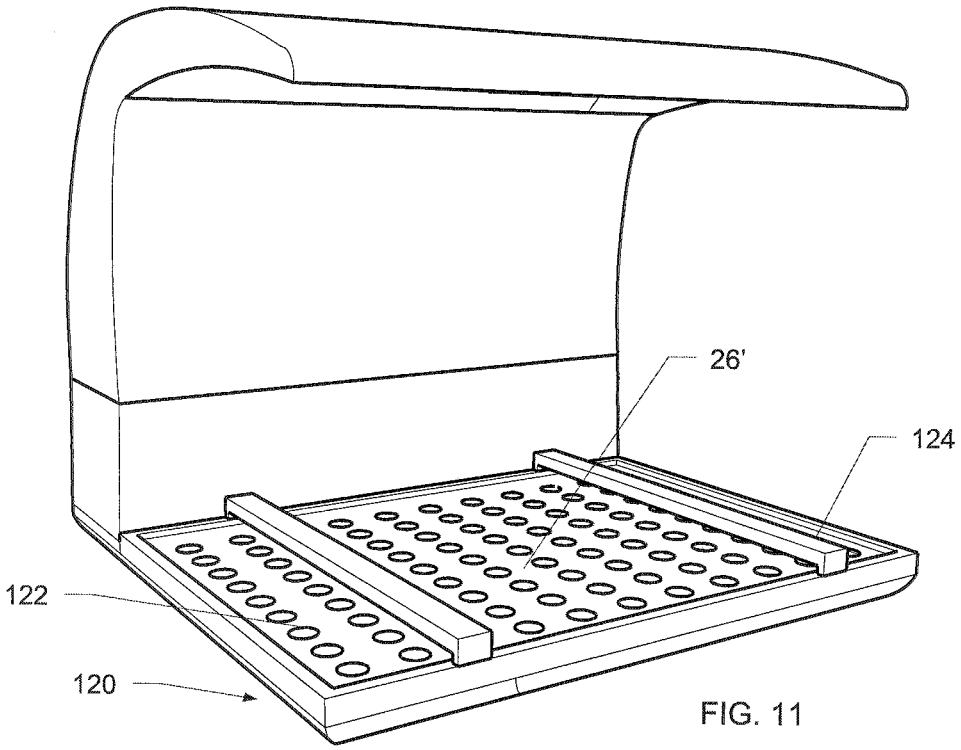
FIG. 11 is a perspective view showing a recirculating ventilation system with a base having a platform pan that has an array of exhaust ports.

Platform pan 26' can have array 120 of exhaust ports 122, as shown in FIG. 11. Each exhaust port 122 is defined by an edge of platform pan 26'. Rails 124 are used to support the cooking appliance and to provide a vertical air flow around the appliance, stripping heat from its exterior. In this case full coverage hood 60*a* would be used, and an air screen is provided by columns of air flowing straight up.

Figure 12:
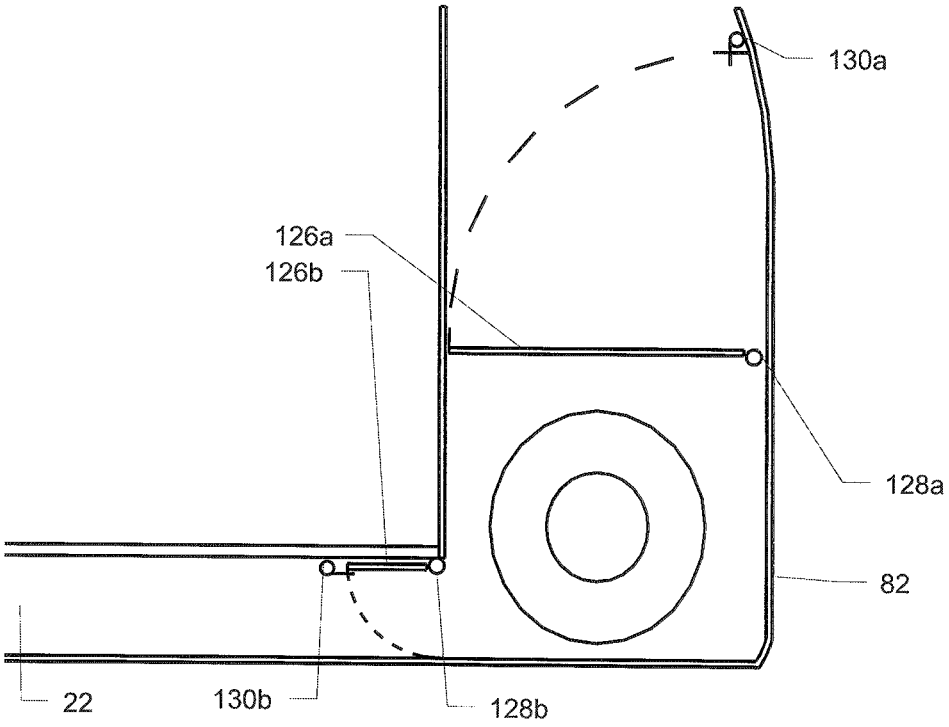
FIG. 12 is a perspective view showing a recirculating ventilation system with fireproof dampers.

Fireproof dampers 126*a*, 126*b* mounted on hinges 128*a*, 128*b* can be provided in riser 82 and base 22 respectively, as shown in FIG. 12. Heat sensitive releases 130*a*, 130*b* automatically cause fireproof dampers 126*a*, 126*b* to close when a preset temperature is reached, interrupting the flow of air. Closing fireproof dampers 126*a*, 126*b* restricts flow of air needed for burning. Closing fireproof dampers 126*a*, 126*b* also contains a fire within the ducts where it can be extinguished with a fire suppressant.

Figure 13:
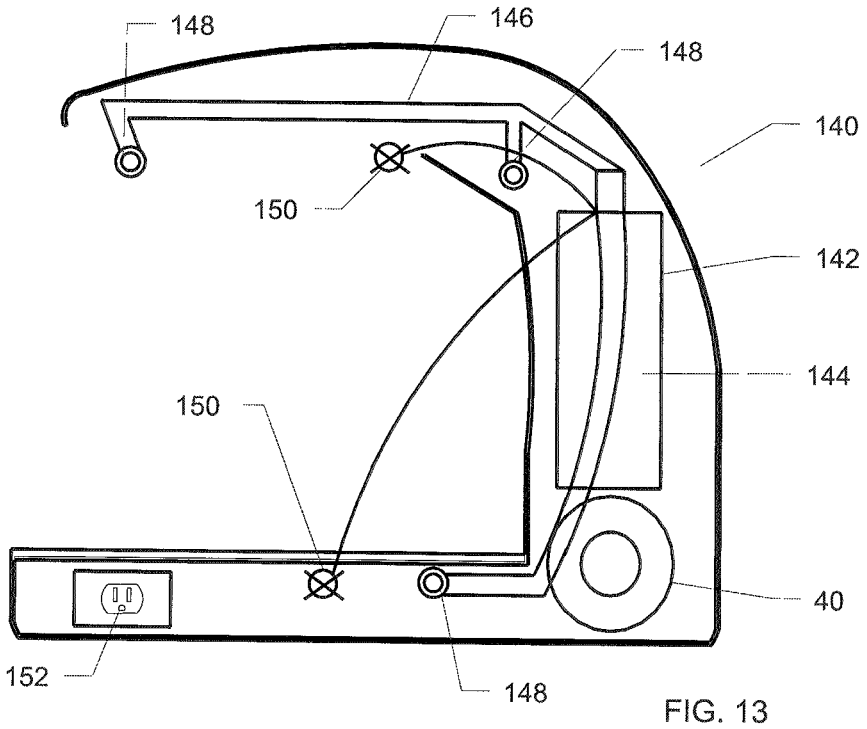
FIG. 13 is a side cross sectional view showing a recirculating ventilation system with a fire suppressant system.

Fire suppression system 140, including fire suppression tank 142 with fire suppressant 144, pipe 146, and chemical spray heads 148 can be provided, as shown in FIG. 13. Fusible links 150 can be provided to initiate activation of fire suppression system 140. A fire will heat at least one of fusible links 150 enough to cause it to melt and open the circuit. Power to outlet 152 for the cooking appliance is automatically disconnected when any one of fusible links 150 opens. Fire suppression system 140 is also activated when any one of fusible links 150 opens. A fire suppressant system of this type is available from Ansul Corporation.

Figure 14:
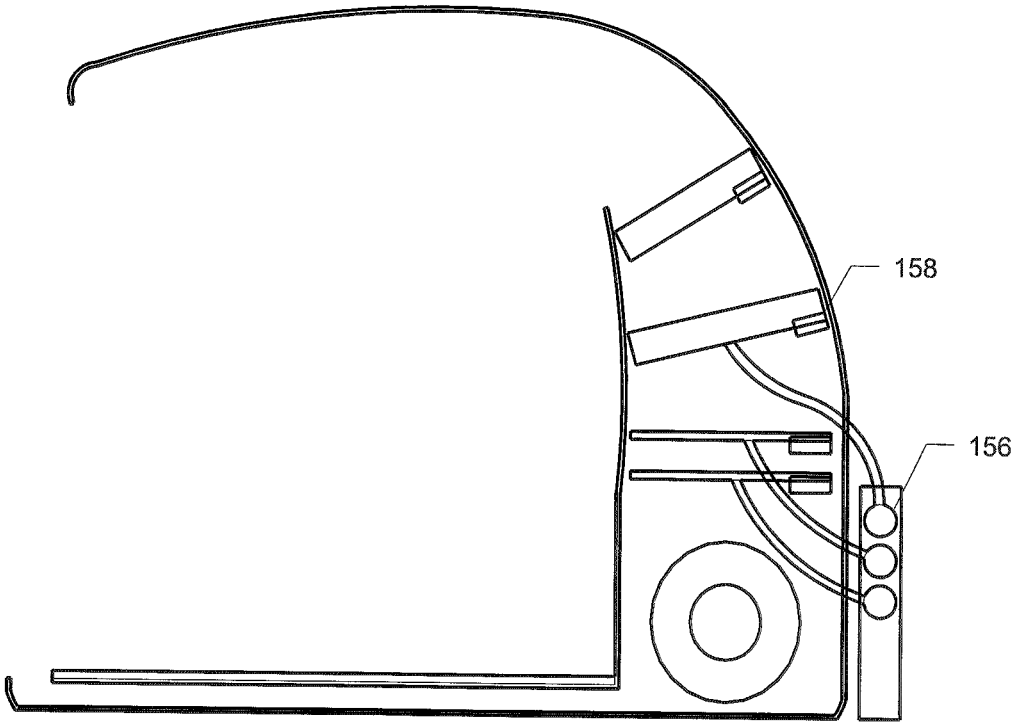
FIG. 14 is a side cross sectional view showing a recirculating ventilation system having filters with pressure switches and filter-in-place switches.

Pressure switches 156 and filter-in-place switches 158 may be included to prevent operation when one of filters 76*a*-76*c* is clogged or is not in place, as shown in FIG. 14.

Filter-in-place switches 158 have a compression rocker switch. When the filter is in place the rocker is depressed closing the circuit, allowing the motor and fan to operate. When the filter is not in place the rocker is not depressed, the circuit is open and the motor and fan do not operate. Filter-in-place switches are available from Arcolectric Wes Garde, part number E3101AAAAB.

Pressure switches 156 have an air tube downstream from each filter. Air entering the tube depresses a micro switch closing the circuit, again allowing the motor and fan to operate. If the filter is too clogged to allow enough air to pass to enter the tube and close the switch completing the circuit, the motor and fan do not operate. Pressure switches are available from Micro Pneumatic Logic Inc., part number MPL-533-T-0.1.

Figure 4C:
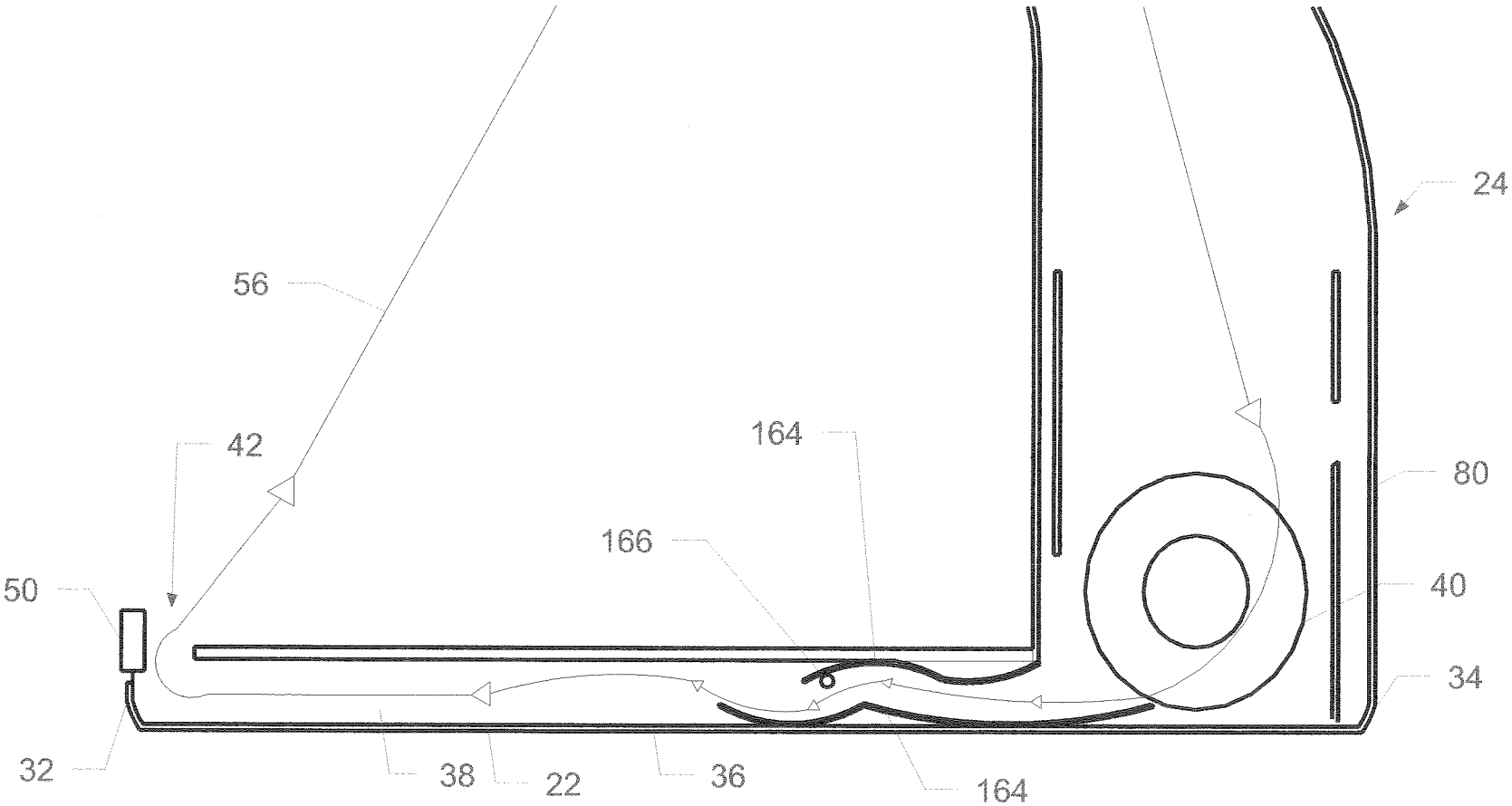
FIG. 4*c* is a side cross sectional view of a recirculating ventilation system similar to those of FIGS. 4*a*, 4*b* and showing an ultraviolet light positioned in the exhaust duct.

Curved metal ducting 164 and ultraviolet light 166 can be provided in base 22, as shown in FIG. 4*c*, to react with pollutants getting through the filters, eliminating odors.

Capture hood 70 includes curved portion 170 that automatically directs rising polluted air toward air intake 60, where it is drawn in, as shown in FIG. 4*a*.

Figure 15:
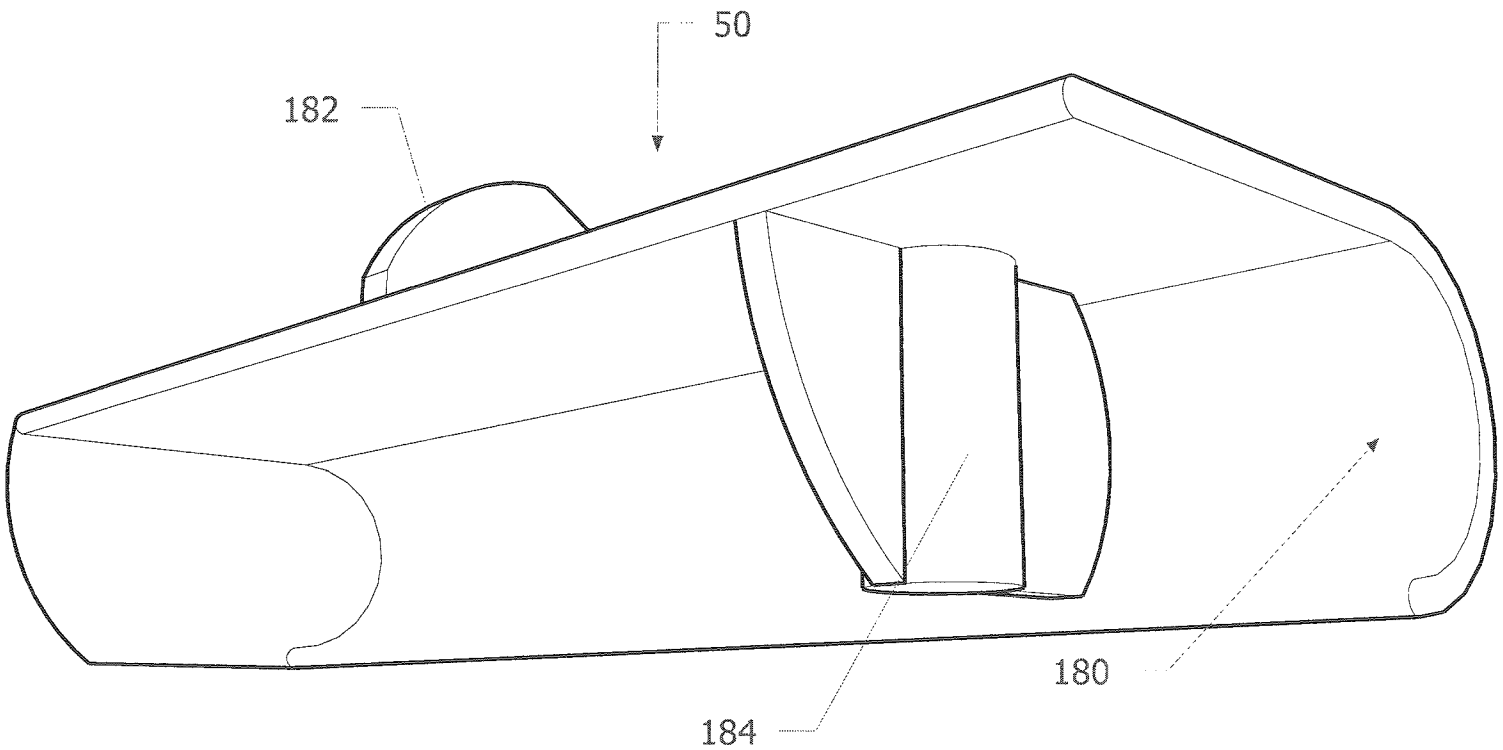
FIG. 15 is a perspective view showing a multi-directional adjustable exhaust louver.

Multi-directional adjustable exhaust louver 50 includes curved portion 180 that automatically directs air flowing in base 22 upward and out of exhaust 42, as shown in FIG. 15. Louver 50 includes handle 182 that allows an operator to easily rotate louver 50. Multi-directional adjustable exhaust louver 50 also includes independently adjustable wing 184 that rotates around an axis perpendicular to the axis of rotation of louver 50. Thus, an operator can direct air around two perpendicular axes.

While several embodiments, together with modifications thereof, have been described in detail herein and illustrated in the accompanying drawings, it will be evident that various further modifications are possible without departing from the scope of the invention as defined in the appended claims. Nothing in the above specification is intended to limit the invention more narrowly than the appended claims. The examples given are intended only to be illustrative rather than exclusive.

What is claimed is:

1. A system for operating a replaceable appliance that may produce polluted air, comprising a recirculating ventilation system, wherein said recirculating ventilation system includes a structure having a base, an intake, and an exhaust, wherein said base includes a base duct section, wherein said base duct section is connected for bringing air taken in through said intake to said exhaust, wherein said base duct section has a first configuration and a second configuration, wherein when said base duct section is in said first configuration said base duct section includes a platform pan that acts as a top surface and encloses said base duct section from above, wherein when said base duct section is in said second configuration said platform pan is removed and said base duct section is open to an environment that is external to the system via an opening created by the absence of said platform pan, wherein enclosing and opening said base duct section with said platform pan allows said base duct section to go back and forth between said first configuration and said second configuration, wherein when said platform pan encloses said base duct section said platform pan is positioned for supporting the replaceable appliance on said base, wherein said exhaust is positioned in said base for exhausting air from said base duct section, and wherein when air is exhausted from said exhaust said exhausted air is drawn to said intake to provide an air curtain.

2. A system as recited in claim 1, wherein said structure further comprises a hood, wherein said intake is located in said hood.

3. A system as recited in claim 2, wherein said intake is positioned to take in the polluted air, wherein said exhaust is located on said base to provide said air curtain for retaining the polluted air substantially over said base.

4. A system as recited in claim 3, wherein said hood includes said intake and wherein said hood has a curved portion for directing rising air toward said intake.

5. A system as recited in claim 3, further comprising a directing member, wherein when said directing member is positioned for directing exhaust air toward said intake to provide said air curtain for retaining the polluted air substantially over said base.

6. A system as recited in claim 5, wherein said base duct section is connected for bringing said air taken in through said intake to said directing member.

7. A system as claimed in claim 5, wherein said directing member includes an adjustable directing member, wherein said adjustable directing member includes an adjusting device for directionally projecting said air curtain toward said intake during operation of the replaceable appliance that generates polluted air.

8. A system as recited in claim 7, wherein said adjustable directing member includes an adjustable air louver unit.

9. A system as recited in claim 8, wherein said adjustable air louver unit includes a curved portion.

10. A system as recited in claim 8, wherein said adjustable air louver unit has a louver axis, wherein said adjustable air louver unit further includes a wing having an axis perpendicular to said louver axis.

11. A system as recited in claim 3, further comprising a motor and a blower, wherein said motor and said blower are located to provide air movement in to said intake and out of said exhaust.

12. A system as recited in claim 11, wherein said blower includes a tangential fan.

13. A system as recited in claim 12, further comprising a first duct section, a second duct section, and a tangential fan housing, wherein said tangential fan housing connects with said first duct section and with said second duct section, wherein said first duct section extends to said intake and wherein said second duct section extends to said base duct section.

14. A system as recited in claim 11, further comprising a filter frame for holding a plurality of removable filters.

15. A system as recited in claim 11, further comprising a riser duct section and a device for removing pollution from the polluted air, wherein said riser duct section extends between said hood and said base, wherein said device for removing pollution from the polluted air is within said riser duct section.

16. A system as recited in claim 15, wherein said device for removing pollution from the polluted air includes at least one component from the group consisting of a particulate filter, an odor filter, a grease filter, and a grease trough.

17. A system as claimed in claim 3, wherein said base has an exhaust port through which said exhausting air passes out of said base unit and toward said intake to provide said air curtain.

18. A system as claimed in claim 17, wherein said platform pan has a plurality of said exhaust ports.

19. A system as recited in claim 2, wherein said structure further comprises a supporting unit, further comprising a plurality of said hoods, wherein each said hood has a different hood shape and wherein each of said hoods has an identical portion for connecting to said supporting unit.

20. A system as recited in claim 1, further comprising said appliance that generates polluted air, wherein said appliance is mounted so said polluted air is contained by said air curtain and captured by said intake.

21. A system as claimed in claim 1, further comprising a fire damper that automatically closes in the presence of a fire.

22. A system as claimed in claim 1, further comprising an appliance electrical connection and a power disconnector, wherein said appliance electrical connection is for providing power to an appliance mounted on said structure, wherein said power disconnector is automatically activated to shut power to said appliance electrical connection in case of a fire.

23. A system as claimed in claim 1, further comprising a fire suppressant system for dispensing fire suppressant.

24. A system as claimed in claim 1, further comprising an ultra-violet light source positioned to treat exhaust air.

25. A system as claimed in claim 1, further comprising a catalytic converter.

26. A system as claimed in claim 1, further comprising an adjustable air intake slot.

27. A system for operating a replaceable appliance that may produce polluted air, comprising a base, an intake, and an exhaust, wherein said base includes a base duct section, wherein said base duct section is connected for bringing air taken in through said intake to said exhaust, wherein said base duct section has a first configuration and a second configuration, wherein when said base duct section is in said first configuration said base duct section includes a platform pan that acts as a top surface and encloses said base duct section from above, wherein when said base duct section is in said second configuration said platform pan is removed and said base duct section is open to an environment that is external to the system via an opening created by the absence of said platform pan, wherein enclosing and opening said base duct section with said platform pan allows said base duct section to go back and forth between said first configuration and said second configuration, wherein when said platform pan encloses said base duct section said platform pan is positioned for supporting the replaceable appliance on said base, wherein said exhaust is defined by an edge of said base duct section and is positioned for exhausting air from said base duct section to said intake to provide an air curtain.

28. A system for operating a replaceable appliance that may produce polluted air, comprising a free standing recirculating ventilation system, wherein said free standing recirculating ventilation system includes a plurality of sides, a base, and an intake, wherein said base includes a base duct section and an exhaust along each of said plurality of sides, wherein said base duct section has a horizontally-disposed top surface positioned to directly contact a bottom of the replaceable appliance when the replaceable appliance sits on said base, wherein said intake is positioned to take in air, wherein said base duct section is connected for bringing air taken in through said intake to said exhaust, wherein said exhausted air is drawn to said intake to provide an air curtain, wherein said air curtain extends from said exhaust along each of said plurality of sides of said base to said intake, and wherein said air curtain extending along said plurality of sides traps the polluted air within said air curtain.

29. A system, as recited in claim 28, further comprising a hood, a riser duct section, and a device for removing pollution from the polluted air, wherein said hood includes said intake, wherein said riser duct section extends between said hood and said base, wherein said device for removing pollution from the polluted air is within said riser duct section.

30. A system as claimed in claim 28, wherein said free standing ventilation system further includes a directing member, wherein said directing member is positioned for directing exhaust air toward said intake to provide said air curtain.

31. A system as claimed in claim 30, wherein said directing member includes an adjustable directing member.

32. A system as claimed in claim 28, wherein said intake takes in air from above said base, wherein said free standing ventilation system includes a filter for filtering polluted air taken in through said intake, wherein said exhaust exhausts air that has pollution removed by said filter, and wherein said exhaust includes a port along each of said plurality of sides to provide said air curtain along each of said plurality of sides.

33. A system as claimed in claim 28, wherein said exhaust includes a directing member to direct said exhausted air toward said intake along said plurality of sides.

34. A system as claimed in claim 28, wherein said top surface of said base duct section includes a portion for supporting the replaceable appliance, wherein said base duct section extends beneath said portion for supporting the replaceable appliance.

35. A system as claimed in claim 28, wherein said top surface of said base duct section includes a platform pan, wherein said platform pan is positioned for enclosing said base duct section and for supporting the replaceable appliance.

36. A system as claimed in claim 35, further comprising said replaceable appliance, wherein said replaceable appliance is mounted on said platform pan, wherein said replaceable appliance emits polluted air.

37. A system for use while operating a replaceable appliance that may produce polluted air, comprising a recirculating ventilation system, wherein said recirculating ventilation system includes a structure having a base, an intake and an exhaust, wherein said base includes a base duct section and said exhaust, wherein said base duct section has a horizontally-disposed top surface positioned to directly contact the replaceable appliance when the replaceable appliance sits on said base, wherein said intake is for taking in air, wherein said base duct section directs air taken in through said intake to said exhaust, wherein said exhaust includes a directing member for directing air exiting said exhaust toward said intake to provide an air curtain, wherein said directing member includes an adjusting handle disposed outside of a region enclosed by the air curtain configured for adjusting a direction of said air curtain toward said intake during operation of the replaceable appliance that generates polluted air.

38. A system as claimed in claim 37, wherein said base has an exhaust port through which said exhausting air passes out of said base and toward said intake to provide said air curtain.

39. A system as claimed in claim 38, wherein said top surface has a plurality of said exhaust ports.

40. A system, as recited in claim 28, wherein no duct extends from said free standing recirculating ventilation system that is connected for exhausting air external to said free standing recirculating ventilation system.

* * * * *